US008739408B2

(12) United States Patent
Duan et al.

(10) Patent No.: US 8,739,408 B2
(45) Date of Patent: Jun. 3, 2014

(54) SHAPE MEMORY MATERIAL PACKER FOR SUBTERRANEAN USE

(75) Inventors: Ping Duan, Cypress, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 309 days.

(21) Appl. No.: 12/985,962

(22) Filed: Jan. 6, 2011

(65) Prior Publication Data

US 2012/0175845 A1 Jul. 12, 2012

(51) Int. Cl.

| | |
|---|---|
| ***B21D 51/16*** | (2006.01) |
| ***E21B 33/12*** | (2006.01) |
| ***F16L 17/00*** | (2006.01) |

(52) U.S. Cl.

USPC ..... 29/890.14; 29/464; 29/522.1; 166/179; 166/387; 277/314

(58) Field of Classification Search

USPC ..... 29/464, 522.1, 523, 888.3, 890.14; 166/179, 203, 369, 387; 277/314, 323, 277/333, 336, 602, 609, 616

See application file for complete search history.

(56) References Cited

U.S. PATENT DOCUMENTS

| | | | | |
|---|---|---|---|---|
| 3,782,458 | A | 1/1974 | Slack | |
| 4,137,970 | A | 2/1979 | Laflin et al. | |
| 4,191,254 | A | 3/1980 | Baughman et al. | |
| 4,415,269 | A | 11/1983 | Fraser | |
| 4,424,865 | A * | 1/1984 | Payton, Jr. | 166/302 |
| 4,475,847 | A | 10/1984 | Cornely et al. | |
| 4,713,870 | A * | 12/1987 | Szalvay | 29/402.09 |
| 5,803,172 | A | 9/1998 | Rajkovich | |
| 6,446,717 | B1 | 9/2002 | White et al. | |
| 6,854,522 | B2 | 2/2005 | Brezinski et al. | |
| 6,907,936 | B2 | 6/2005 | Fehr et al. | |
| 6,907,937 | B2 | 6/2005 | Whanger et al. | |
| 6,976,537 | B1 | 12/2005 | Verret | |
| 7,392,852 | B2 * | 7/2008 | Richard | 166/387 |
| 7,735,567 | B2 | 6/2010 | O'Mally et al. | |
| 7,743,825 | B2 | 6/2010 | O'Malley et al. | |
| 7,841,417 | B2 * | 11/2010 | Allison et al. | 166/387 |
| 8,353,346 | B2 * | 1/2013 | Johnson et al. | 166/300 |
| 2004/0194970 | A1 * | 10/2004 | Eatwell et al. | 166/387 |
| 2005/0205263 | A1 | 9/2005 | Richard | |
| 2006/0124304 | A1 | 6/2006 | Bloess et al. | |

(Continued)

FOREIGN PATENT DOCUMENTS

| | | | |
|---|---|---|---|
| WO | 03014517 | A1 | 2/2003 |
| WO | 2005052316 | A2 | 6/2005 |
| WO | 2005059304 | A1 | 6/2005 |

*Primary Examiner* — Alexander P Taousakis

(74) *Attorney, Agent, or Firm* — Steve Rosenblatt

(57) ABSTRACT

A shape memory polymer is initially fabricated to a size where its peripheral dimension will be at least as large as the borehole wall in which it is to be deployed. After the initial manufacturing the material temperature is elevated above the transition temperature and the material is stretched on a mandrel to retain its inside dimension as its outside dimension is reduced to size that will allow running the seal to a desired subterranean location without failing the material during the stretching. The material is allowed to cool below the transition temperature to hold the new shape. The material on the mandrel is then secured to a tubular string and delivered to the desired location. Wellbore fluid at given temperature raises the material again above the transition temperature, which causes the material to revert to its originally manufactured shape.

20 Claims, 2 Drawing Sheets

(56) References Cited

U.S. PATENT DOCUMENTS

2007/0240877 A1* 10/2007 O'Malley et al. ..... 166/179
2010/0089565 A1* 4/2010 Duan et al. ..... 166/51
2010/0294485 A1* 11/2010 Lynde ..... 166/179
2012/0305253 A1* 12/2012 O'Malley ..... 166/302

* cited by examiner

SHAPE MEMORY MATERIAL PACKER FOR SUBTERRANEAN USE

FIELD OF THE INVENTION

The field of the invention is isolation devices for downhole use and more particularly those that employ shape memory polymers and are initially shaped for the set dimension and reconfigured for a smaller dimension for run in followed by reversion to the manufactured shape when exposed to downhole fluids at given temperature and time.

BACKGROUND OF THE INVENTION

Shape memory materials have been used in packers to isolate portions of a wellbore as illustrated in U.S. Pat. Nos. 7,743,825 and 7,735,567. In these patents a packer made of a shape memory polymer (SMP) was delivered to a subterranean location and a heat input was applied using well fluids or a heater and an auxiliary compressive force applied to the packer element when it was made softer by the application of heat. The outside compressive force continued to be applied as the set position was achieved and the heat source was removed. The SMP then grew more rigid as it cooled with the mechanical force applied and the packer was ready for service. The sealing force in those references derived from the mechanical compression under heating conditions rather than any inherent shape memory features of the material. However, the methods described in these patents may require additional heating sources or a heating element to raise the temperature above the material's soft point or transition temperature. Therefore, it is desirable to have a material that can change shape from one to another by itself at downhole conditions to create sealing. The material can be run in hole in a small diameter, and activated to expand to larger diameter to fill space between a mandrel and a surrounding borehole. The material should preferably also be strong to maintain boost loads for sealing.

Relevant art to the present invention includes U.S. Pat. Nos. 6,976,537; 6,907,937; 6,907,936; 6,854,522; 6,446,717; 5,803,172; 4,475,847; 4,415,269; 4,191,254; 4,137,970 and 3,782,458 and U.S. patent applications: 2006/0124304 and 2005/0205263 as well as PCT references: WO 05059304; WO 05052316 and WO 03014517.

The present invention takes advantage of the shape memory feature of the material by making the material initially to the desired set dimension when the packer is placed at the desired subterranean location. Thus the ultimate set dimension is the dimension to which the packer element is initially produced. Before deployment the packer material is stretched when heated with a dummy or the actual mandrel placed inside. The material is stretched to reduce the outside dimension as much as possible without failure in a manner that keeps the inside diameter constant because the mandrel is in position. The material is cooled while retaining the stretching force so that a run in shape is developed. The run in shape has a lower profile for running in and the shape that the element will revert when heated downhole is the original manufactured shape. Regaining the original shape puts the element into contact with the surrounding wellbore wall. The seal made by such contact can be enhanced by an applied mechanical force. Those skilled in the art will better appreciate the full scope of the invention from a description of the preferred embodiment and the associated drawings while recognizing that the full scope of the invention is to be determined from the appended claims.

SUMMARY OF THE INVENTION

A shape memory polymer is initially fabricated to a size where its peripheral dimension will be at least as large as the borehole wall in which it is to be deployed. After the initial manufacturing the material temperature is elevated above the glass transition temperature and the material is stretched on a mandrel to retain its inside dimension as its outside dimension is reduced to size that will allow running the seal to a desired subterranean location without failing the material during the stretching. The material is allowed to cool below the glass transition temperature to hold the new shape. The material is designed and fabricated so that its glass transition temperature is preferably near downhole temperature. The material on the mandrel is then secured to a tubular string and delivered to the desired location where it contacts wellbore fluid at a wellbore temperature which is usually higher than surface temperature. The hot wellbore fluid raises the material again above the material glass transition temperature, which causes the material to revert to its originally manufactured shape. The original shape is at least as large as or larger than the borehole size so that a seal ensues. Optionally, external force can also be applied as the material is heated to cross its transition temperature and that force can be retained to provide an assist to sealing beyond that created by the reversion of the material to the initially manufactured shape.

DETAILED DESCRIPTION OF THE PREFERRED EMBODIMENT

Figure 1:
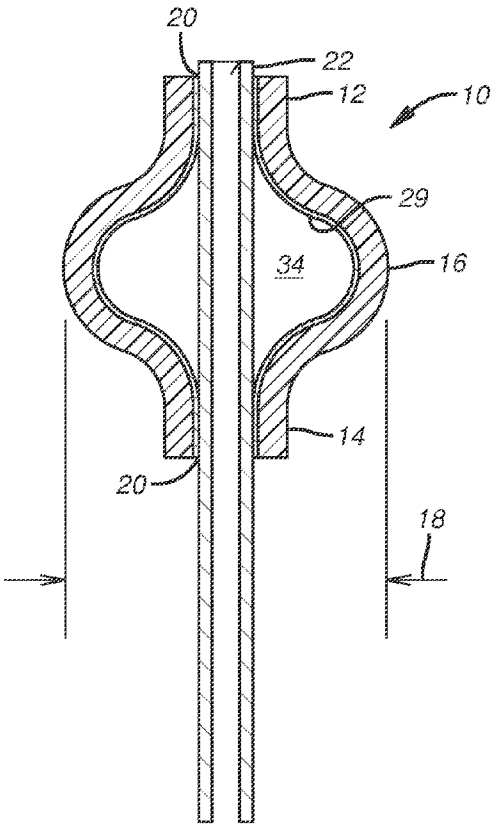
FIG. 1 is a section view of an as manufactured element put on a mandrel.

FIG. 1 shows a sealing element 10 having ends 12 and 14 and a middle section 16 that is curved radially outwardly to a dimension 18 when initially manufactured. In that sense the element 10 has a variable manufactured dimension as referenced to its diameter being variable along its length. Dimension 18 equals or exceeds the borehole dimension at the deployment location 20. The element 10 can be made in a mold or otherwise fabricated to an outer dimension 18 and further with a bore 20 that will allow a mandrel 22 to be inserted before the next manufacturing step.

While in the FIG. 1 as manufactured condition with the mandrel 22 in position, the element 10 is heated as schematically represented by arrow H. As it softens when the transition temperature of the shape memory polymer that is the preferred material for the element 10 is heated as represented by arrow H, a tensile force represented by arrow F is applied. As a result the internal dimension of the element 10 remains the external dimension 24 of the mandrel 22. The amount of applied force represented by arrow F is controlled so that the exterior dimension 26 is reduced with respect to the manufactured exterior dimension 18 shown in FIG. 1. In one end position of the stretching under the force F the exterior dimension 26 winds up at the manufactured thickness of ends 12 or 14 in FIG. 1. Alternatively, the end dimension under the application of force F as the element is above the transition temperature can be to a smaller dimension than the manufactured dimension of the ends 12 or 14 as shown in FIG. 1. Those skilled in the art will realize that the smaller the run in exterior dimension the faster the element 10 can be run into a given borehole. On the other hand, care must be taken to avoid overstretching in the heated condition for there is a possibility of creating thin portions or even having the wall of the element 10 simply fail if the applied force F is too high or applied for too long.

Figure 2:
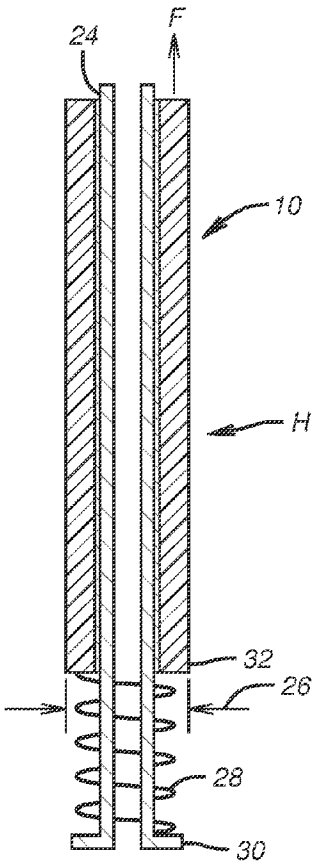
FIG. 2 is the view of FIG. 1 showing an optional spring added on the mandrel and the element stretched while above its transition temperature and allowed to cool on the mandrel before running in to a subterranean location.

A biasing member 28 which can be a coiled spring or a stack of Belleville washers or other equivalent structure can be optionally slipped over the mandrel 22 so that it finds support off of flange 30 and bears against the lower end 32 of the element 10 after the stretching using force F is accomplished with the element above its transition temperature followed by allowing the element to be cooled down so that it holds its stretched shape shown in FIG. 2. The spring is optional and if used can be held in a compressed state as the element 10 is stretched as shown schematically with force F.

It should also be noted that in the original manufacturing shown in FIG. 1, the mandrel 22 can already be in position for example in the mold that is used to manufacture the initial shape. Alternatively, the mandrel 22 can be inserted through the openings 20 past both ends 12 and 14 with preferably an interference fit so as to minimize leakage flow through the interior of the element 10 and along the mandrel 22 when ultimately deployed as in FIG. 3.

Referring again to FIG. 2, when the desired dimension on the exterior of the element 10 is reached, the heat H is removed and the force F is subsequently removed as the consistency of the element 10 gets firmer. If the optional biasing member 28 is used and pre-compressed, any retainers holding the member 28 in the compressed position are released and the biasing member bears against the element 10.

The element is then made a part of a tubular string (not shown) and run into a subterranean location whose opening size 21 is no larger than the manufactured outer dimension 18 shown in FIG. 1. As well fluid or an auxiliary heat source H' is applied, the shape of the element 10 reverts to the FIG. 1 as fabricated shape and the central section 16 extends to dimension 18 which seals against the borehole dimension 21 especially if the size of the borehole 21 is smaller than the manufactured outer dimension 18. If the optional biasing device 28 is used then an additional sealing force is applied to hold the section 16 against the borehole wall whether it is in open hole or cased or lined hole. It should be noted that the length of the element 10 shrinks in the axial direction of arrow F as it grows in the radial direction, as seen by comparing FIGS. 2 and 3. The biasing device 28 ideally has enough axial movement capability to compensate for the axial shrinkage of the element 10 and still have an available force that can be delivered into the element 10 to create or to enhance the seal against the borehole dimension 21.

While the biasing device 28 is shown at end 14, those skilled in the art will appreciate that other locations and more than one biasing device 28 can be used. For example, the biasing device can be installed near each end 12 and 14. Alternatively, the biasing device can be inserted in region 34 and can be in the form of a leaf spring 29 supported by the mandrel 22. When the element 10 is then heated and stretched after being manufactured, the leaf spring is flattened and held in that position as the temperature is then lowered and the force F removed to hold the leaf spring in the flattened position. When warmed in the subterranean location with heat H', the element as before reverts to its manufactured shape and the spring acts to push out the central portion 16 to create or enhance the seal.

As another option for a biasing member 28 or 29, the material used can be a shape memory alloy fabricated for a long dimension and reformed above its transition temperature to a shorter length or extension when assembled to the mandrel 22. If used as a leaf spring 29 it can be reformed to flat before insertion in an annular space 34 or in the element 10 and before the element 10 has its outer dimension reduced using force F. When at the subterranean location and heat in the form of H' is delivered, the biasing member reverts to its manufactured shape and original length and in so doing applies a force to the element 10 to create or enhance the seal. If used as a leaf spring the manufactured shaped can be bowed and then it can be heated and reshaped above its transition temperature and inserted in space 34 or within the element 10 itself. At the subterranean location the applied heat H' will cause the spring to bow and push out the central section 16 to initiate or enhance the seal at dimension 21.

Arrow 36 schematically represents another option of being able to deliver a fluid into space 34 and selectively retain the fluid in the space 34 to initiate or enhance the seal against dimension 21.

Figure 3:
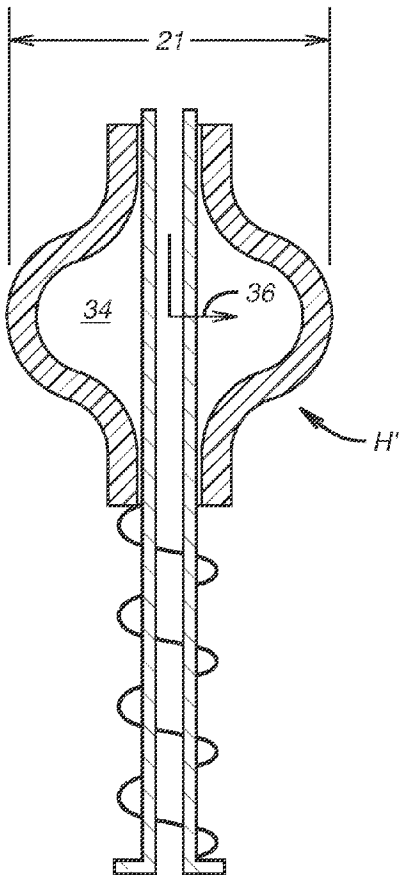
FIG. 3 is the view of FIG. 2 when the element is at the subterranean location and has reverted to its manufactured shape of FIG. 1 due to crossing its transition temperature with the spring providing additional sealing force.
Figure 6:
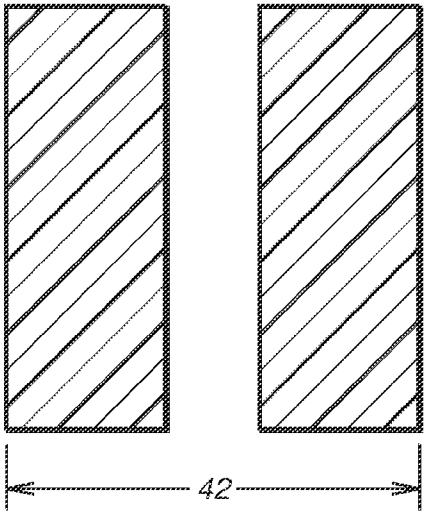
FIG. 6 is the view of FIG. 5 with the seal at the subterranean location and the seal having crossed its transition temperature to assume a sealing position in the borehole.
Figure 5:
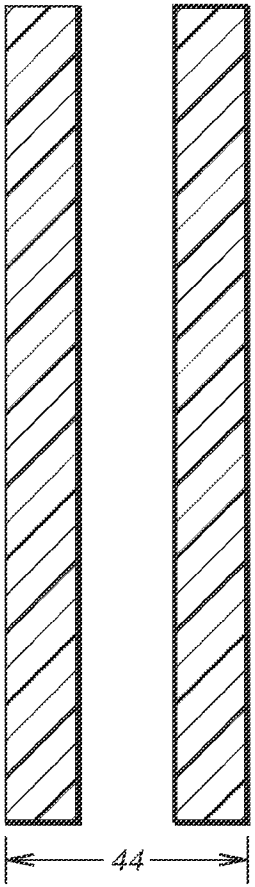
FIG. 5 shows the seal brought above its transition temperature and stretched on a mandrel and allowed to cool down prior to running into a subterranean location.
Figure 4:
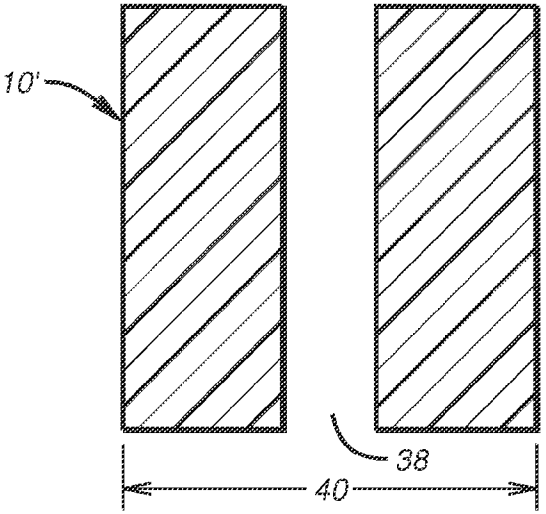
FIG. 4 is an alternative embodiment to FIG. 1 where the original manufactured shape is cylindrical.

FIGS. 4-6 represent what was shown and discussed as to FIGS. 1-3 with the FIGS. 4-6 more simplified so that the mandrel or the biasing devices are not shown. The mandrel is still used and the biasing device is optional as before. The point of these three FIGS. is that the manufactured shape can be a cylinder with a bore 38 through the seal 10'. Comparing to the FIG. 1 shape where there was a bowed out central section 16, in FIGS. 4-6 the manufactured outer dimension 40 is at least as great as the set position with the borehole at dimension 42. Dimension 44 at the end of the fabrication and reforming steps of FIGS. 4 and 5 is smaller than the drift dimension of the borehole shown schematically as 42. Thus exposure to heat H" at the subterranean location has the element 10' trying to assume the manufactured dimension 40 to create a borehole seal. As with FIGS. 1-3 the outlined options for a bias force to aid in or create the sealing contact in the borehole are still operative.

Those skilled in the art will appreciate the in the past when using shape memory polymers for a sealing element such as in U.S. Pat. No. 7,735,567 it was assumed that the nature of the shape memory polymer was such that recovery of the original manufactured shape could not generate the potential energy to create a seal. The present method seeks to take advantage of shape recovery to accomplish a seal whether aided with biasing members or applied fluid force or not. Accordingly the manufactured shape is large enough to create a seal when reverting to that shape happens downhole. Further, is the step of reducing the run in diameter with stretching on a mandrel when the element is above the transition temperature so as to minimize damage during run in and to permit a faster speed for running in while still being able to create a seal when the transition temperature is crossed again at the subterranean location, whether aided by a biasing member or not. As described the biasing member can take a variety of shapes and can optionally be made of a shape memory alloy which delivers a greater potential energy force when reverting to its manufactured shape on heat input at a downhole location. The manufactured shape can be cylindrical on the outside or it can have a central segment that is bowed out to ease sealing ability during reversion to the original shape downhole.

While a single element is shown, multiples can be used in a single assembly with the manufactured shapes being identical or different.

The above description is illustrative of the preferred embodiment and many modifications may be made by those skilled in the art without departing from the invention whose scope is to be determined from the literal and equivalent scope of the claims below:

We claim:

1. A method of using a seal for a subterranean location having a borehole dimension, comprising:

providing a shape memory element to a manufactured peripheral dimension at least as large as the borehole dimension and extending for at least a portion of the length of said element;

reducing said peripheral dimension to less than the borehole dimension before running in;

running in said element on a mandrel to the subterranean location;

allowing said element to revert to said manufactured peripheral dimension to seal at the subterranean location;

biasing said element with a biasing member supported on a mandrel and contacting said shape memory element, after said allowing said element to revert to said manufactured peripheral dimension, to enhance the seal at the subterranean location.

2. The method of claim 1, comprising:

raising the temperature of said element to above its transition temperature before said reducing.

3. The method of claim 2, comprising:

inserting said mandrel through a bore in said element before said raising the temperature of said element.

4. The method of claim 3, comprising:

providing an axial tensile force to said element when said element is mounted to said mandrel to reduce said manufactured peripheral dimension.

5. The method of claim 1, comprising:

inserting a mandrel through a bore in said element before said reducing said peripheral dimension.

6. The method of claim 5, comprising:

providing an interference fit in said bore of said element for said inserting.

7. The method of claim 1, comprising:

making said manufactured peripheral dimension larger than the subterranean location borehole dimension.

8. A method of using a seal for a subterranean location having a borehole dimension, comprising:

providing a shape memory element to a manufactured peripheral dimension at least as large as the borehole dimension and extending for at least a portion of the length of said element;

reducing said peripheral dimension to less than the borehole dimension before running in;

running in said element on a mandrel to the subterranean location;

allowing said element to revert to said manufactured peripheral dimension to seal at the subterranean location;

raising the temperature of said element to above its transition temperature before said reducing;

inserting a mandrel through a bore in said element before said raising the temperature of said element;

providing an axial tensile force to said element when said element is mounted to said mandrel to reduce said manufactured peripheral dimension;

mounting a biasing member on said mandrel before providing said axial tensile force.

9. The method of claim 8, comprising:

locating said biasing member outside said element adjacent at least one of opposed ends of said element.

10. The method of claim 8, comprising:

locating said biasing member between said element and said mandrel.

11. The method of claim 8, comprising:

providing a preload force on said element from said biasing member after the temperature of said element goes below the transition temperature said axial tensile force is released.

12. The method of claim 8, comprising:

using a constant manufactured peripheral dimension for the length of said element.

13. The method of claim 8, comprising:

using a variable manufactured peripheral dimension for said element that has a larger dimension between ends thereof

14. The method of claim 13, comprising:

reducing said larger dimension during said reducing.

15. The method of claim 13, comprising:

reducing the entirety of said variable manufactured peripheral dimension during said reducing.

16. A method of using a seal for a subterranean location having a borehole dimension, comprising:

providing a shape memory element to a manufactured peripheral dimension at least as large as the borehole dimension and extending for at least a portion of the length of said element;

reducing said peripheral dimension to less than the borehole dimension before running in;

running in said element on a mandrel to the subterranean location;

allowing said element to revert to said manufactured peripheral dimension to seal at the subterranean location;

raising the temperature of said element to above its transition temperature before said reducing;

inserting a mandrel through a bore in said element before said raising the temperature of said element;

providing an axial tensile force to said element when said element is mounted to said mandrel to reduce said manufactured peripheral dimension;

mounting a biasing member on said mandrel before providing said axial tensile force;

locating said biasing member within said element.

17. A method of using a seal for a subterranean location having a borehole dimension, comprising:

providing a shale memory element to a manufactured peripheral dimension at least as large as the borehole dimension and extending for at least a portion of the length of said element;

reducing said peripheral dimension to less than the borehole dimension before running in;

running in said element on a mandrel to the subterranean location;

allowing said element to revert to said manufactured peripheral dimension to seal at the subterranean location;

raising the temperature of said element to above its transition temperature before said reducing;

inserting a mandrel through a bore in said element before said raising the temperature of said element;

providing an axial tensile force to said element when said element is mounted to said mandrel to reduce said manufactured peripheral dimension;

mounting a biasing member on said mandrel before providing said axial tensile force;

manufacturing said biasing member from a shape memory polymer.

18. The method of claim 17, comprising:

raising the temperature of said biasing member to above its transition temperature and reshaping said biasing member when above said transition temperature before mounting said biasing member to said mandrel;

applying a force to said element at the subterranean location due to reverting of said biasing member to said manufactured shape when the temperature of said biasing member is again raised above the transition temperature.

19. A method of using a seal for a subterranean location having a borehole dimension, comprising:

providing a shape memory element to a manufactured peripheral dimension at least as large as the borehole dimension and extending for at least a portion of the length of said element;

reducing said peripheral dimension to less than the borehole dimension before running in;

running in said element on a mandrel to the subterranean location;

allowing said element to revert to said manufactured peripheral dimension to seal at the subterranean location;

using a variable manufactured peripheral dimension for said element that has a larger dimension between ends thereof;

inserting a mandrel in an interference fit in a bore through said element before said reducing;

locating a biasing member in an annular space between said mandrel and said larger dimension or in the element itself at said larger dimension.

20. The method of claim 19, comprising:

using a shape memory alloy leaf spring as said biasing element;

initially reforming said shape memory alloy leaf spring to a flat condition when holding it above its transition temperature prior to mounting said leaf spring in said annular space or in the element itself and before said reducing.

* * * * *

UNITED STATES PATENT AND TRADEMARK OFFICE

CERTIFICATE OF CORRECTION

PATENT NO. : 8,739,408 B2
APPLICATION NO. : 12/985962
DATED : June 3, 2014
INVENTOR(S) : Ping Duan et al.

It is certified that error appears in the above-identified patent and that said Letters Patent is hereby corrected as shown below:

In the claims

At column 5, line 34, please delete “a mandrel” and insert -- the mandrel --.

At column 6, line 6, please delete “a mandrel” and insert -- the mandrel --.

At column 6, line 52, please delete “a mandrel” and insert -- the mandrel --.

At column 7, line 8, please delete “a mandrel” and insert -- the mandrel --.

At column 8, line 15, please delete “a mandrel” and insert -- the mandrel --.

Signed and Sealed this
Twenty-second Day of March, 2016

Michelle K. Lee

Michelle K. Lee
*Director of the United States Patent and Trademark Office*